US007422510B2

(12) United States Patent
Schneider et al.

(10) Patent No.: US 7,422,510 B2
(45) Date of Patent: Sep. 9, 2008

(54) LENS MACHINING MACHINE

(75) Inventors: Gunter Schneider, Marburg (DE); Helwig Buchenauer, Dautphetal-Buchenau (DE); Klaus Krämer, Dautphetal-Friedensdorf (DE)

(73) Assignee: Schneider GmbH & Co. KG (DE)

( * ) Notice: Subject to any disclaimer, the term of this patent is extended or adjusted under 35 U.S.C. 154(b) by 340 days.

(21) Appl. No.: 10/574,326

(22) PCT Filed: Apr. 28, 2005

(86) PCT No.: PCT/EP2005/051923

§ 371 (c)(1),
(2), (4) Date: Apr. 3, 2006

(87) PCT Pub. No.: WO2005/105372

PCT Pub. Date: Nov. 10, 2005

(65) Prior Publication Data

US 2008/0051015 A1 Feb. 28, 2008

(30) Foreign Application Priority Data

Apr. 30, 2004 (DE) ..... 10 2004 021 721

(51) Int. Cl.
*B24B 49/00* (2006.01)

(52) U.S. Cl. ..... 451/5; 451/10; 451/11; 451/43; 451/290; 451/384

(58) Field of Classification Search ..... 451/5, 451/10, 11, 42, 43, 44, 277, 289, 290, 384
See application file for complete search history.

(56) References Cited

U.S. PATENT DOCUMENTS 4,216,626 A * 8/1980 Starp ..... 451/163
4,392,331 A * 7/1983 Schimitzek et al. ..... 451/159
4,419,846 A * 12/1983 Schimitzek et al. ..... 451/159
5,951,376 A * 9/1999 Mandler ..... 451/43
7,153,184 B2 * 12/2006 Kuebler et al. ..... 451/5
2002/0006764 A1 1/2002 Hanisch et al.

(Continued)

FOREIGN PATENT DOCUMENTS

DE 198 00 841 7/1999

(Continued)

*Primary Examiner*—Eileen P. Morgan
(74) *Attorney, Agent, or Firm*—Hudak, Shunk & Farine Co. LPA

(57) ABSTRACT

The invention relates to a machining machine for lenses, which comprises a first workpiece drive, configured as the transport receptacle and having a workpiece spindle, a workpiece changer for exchanging workpieces between the workpiece drive and a workpiece stock, and a machining station for machining a workpiece. The workpiece spindle of the workpiece drive can be rotated about an axis of rotation (c1). The workpiece drive can be swiveled about a first swiveling axis (b1) which is arranged at a right angle to the axis of rotation (c1). The work piece drive can be rotated about an axis of rotation (k) which is arranged at a right angle to the first swiveling axis (b1). The machining machine according to the invention is characterized in that at least one further workpiece drive is provided and has a spindle that can be rotated about a respective axis of rotation (c1, c2). Both workpiece drives can be swiveled about a first swiveling axis (b1, b2) which is arranged at a right angle to the respective axis of rotation (c1, c2). Both workpiece drives can be displaced and driven in a translatory manner about a translatory axis of displacement (x1, x2) which is arranged at a right angle to the first swiveling axis (b1, b2). Both workpiece drives can be rotated together about the axis of rotation (k).

21 Claims, 3 Drawing Sheets

U.S. PATENT DOCUMENTS

| | | | | |
|---|---|---|---|---|
| 2003/0043343 | A1* | 3/2003 | Diehl et al. | 351/177 |
| 2004/0229553 | A1* | 11/2004 | Bechtold et al. | 451/42 |
| 2007/0293128 | A1* | 12/2007 | Schafer et al. | 451/7 |

FOREIGN PATENT DOCUMENTS

| | | |
|---|---|---|
| DE | 102 48 104 | 5/2003 |
| EP | 1 175 962 | 1/2002 |

* cited by examiner

LENS MACHINING MACHINE

FIELD OF INVENTION

The invention pertains to a machining machine for lenses according to the claims, as well as a method for operating the machining machine. At issue is a machining machine for optical lenses with a first workpiece drive configured as a transport receptacle with a workpiece spindle having a chuck, a workpiece changer configured as a workpiece turnover for exchanging workpieces between the workpiece drive and a workpiece stock, and a machining station for machining a workpiece, wherein the workpiece spindle of the workpiece drive can rotate about an axis of rotation c1 and the workpiece drive can swivel about a first swivel axis b1, arranged at right angle to the axis of rotation c1, and the workpiece drive can turn about a turning axis k arranged at right angles to the first swivel axis b1.

BACKGROUND OF THE INVENTION

A lens machining machine is already known from DE 102 48 104 A1. This lens machining machine has a table with at least two work or tool stations, which are positioned via a workpiece spindle arranged on a robot arm. The workpiece spindle of the robot arm has both a lens mount and a tool gripping device. The robot or robot arm used here is on the one hand very costly and on the other hand affords a limited polishing or machining force, depending on its radius of action.

The underlying problem of the invention is to configure and arrange a lens machining machine so that a fast and efficient machining of the workpiece is assured.

SUMMARY OF THE INVENTION

This problem is solved by the invention, in a lens machining machine of the type in question, by providing at least one second workpiece drive, and the second workpiece drive has a spindle which can turn about an axis of rotation c1, c2, while both workpiece drives can swivel about a first swivel axis b1, b2 arranged at right angle to the respective axis of rotation c1, c2 and both workpiece drives are driven in translatory motion and able to move in the direction of a translatory axis of displacement x1, x2, arranged at right angles to the first swivel axis b1, b2, and both workpiece drives can be rotated together about the turning axis k.

In this way, by utilizing the aforesaid axes in conjunction with available drive units for the axes, such as circulating ball spindle drives, one achieves on the one hand the requisite diversity of motion of the workpiece drives and on the other hand the desired machining force for the workpiece drives. In addition, a simple parallel use of a second workpiece drive is possible, so that the processing time for a pair of lenses is roughly in the range of the processing time for one lens using a robot arm. It should be noted that lenses are basically manufactured in pairs, so that thanks to the use of two workpiece drives and two machining stations one substantially simplifies the logistics, i.e., the bringing up and carrying away of the lenses, as well as the machining cycle for the lenses. The two workpiece drives each have a spindle rotation axis c1, c2, thereby providing a guided rotation of the workpieces. The respective spindle or the respective workpiece drive can be swiveled about the first swivel axis b1, b2 in a pendulum motion. This pendulum motion is provided by a swivel motor. The swivel motor is arranged together with the respective workpiece drive on a translation carriage, able to move in translation. The translation carriage moves in the direction of the axis of translation and is separately actuated and driven for each workpiece drive and each swivel motor. The two workpiece drives thus constructed, including the swivel motors and the translatory carriages, are together arranged on a swivel unit configured as a swivel plate and are swiveled via this swivel plate about the turning axis k and optionally lifted or lowered in a direction parallel to a lifting axis w. Preferably, the position and the orientation of the lifting axis w and the turning axis k. The swivel motion about the turning axis k serves for the horizontal positioning of the two workpiece drives in the region of a machining station, on the one hand, and in the region of a workpiece changer or workpiece stock, or a washing station, on the other hand. The lifting and lowering motion in the direction of the lifting axis w serves for a vertical positioning in the region of the washing station or the workpiece changer and in the region of the machining station.

An additional possibility, according to a further modification, is that the workpiece drives have a common translatory lifting axis w, arranged in parallel with or coaxial to the swivel axis k, being mounted able to move and being actuated in its direction. This ensures the joint movement of the two workpiece drives in regard to a fast and sufficiently precise positioning.

In particular, during touch-up machining of the workpieces, the independent movement ensures an optimal and efficient machining process. The lifting and lowering motion in the direction of the lifting axis w serves to generate the desired bearing force during the machining process, in addition to a positioning in the region of the machining station or in the region of the tool changer.

It is also beneficial to provide two workpiece changers, the particular workpiece changer being driven in translation and able to move about a swivel axis s arranged at right angles to the lifting axis w between a position W1 underneath the workpiece drive and at least one position W2 above the workpiece stock and in the direction of a vertical lowering axis n1, n2 arranged in parallel with the lifting axis w, and the workpiece can be transported by the workpiece changer between a position beneath the workpiece drive and a position above the workpiece stock and swiveled through 180°. Thanks to this swivel axis s, the workpiece starting from its position on the conveyor belt is turned through 180°, i.e., its bottom side pointing downward on the conveyor belt is pointing upward after the swivel motion, so that the workpiece drive can grab it there. The translatory motion in the direction of the lowering axis n1, n2 besides orienting in terms of angle position as provided by the swivel axis s also provides an orienting in terms of height, for purposes of handing off the particular workpiece to the workpiece drive or picking it up from the conveyor belt. Both the lowering and the swiveling motion about the axis s occur preferably for each workpiece changer.

It is also envisioned that the work station be configured as a polishing station and have at least two driven polishing plates, each of which is mounted able to turn about a polishing axis p1, p2 and guided in the direction of a translatory telescoping axis z1, z2, arranged in parallel with or coaxial to the polishing axis p1, p2. The polishing plates are arranged so that each time one workpiece drive can be positioned above one of the polishing plates. The two workpieces can then be machined at the same time and independently of each other, since the particular workpiece drive can be used to adjust the relative speed between the tool and the workpiece, on the one hand, and the telescoping drive can be used to adjust the particular bearing force, on the other. Since it is necessary to work with polishing tools which are smaller than the actual lens being machined, especially when machining or polishing transition lenses, the aforementioned axes of movement, i.e., the respective axis of rotation c1, c2, the two swivel axes b1, b2, the two displacement axes x1, x2 as well as the two polishing axes p1, p2 and the two telescopic axes z1, z2 are helpful in securing the desired individual, local removal of material. The workpiece forms the axial stop for the telescoping tool or polishing plate in relation to the telescopic axes z1, z2. Thus, the particular bearing pressure, the angle position between the polishing plate and the workpiece, the required relative velocity between the polishing plate and the workpiece, and the lateral offset between the polishing plate and the workpiece can be adjusted for purposes of machining of the entire lens surface.

It is important to the present invention that the respective polishing plate is driven by an air-cushioned telescopic drive which can turn about the polishing axis p1, p2 and move in parallel with the polishing axis p1, p2, while the polishing plate is connected to the telescopic drive and the polishing shaft via a bellows and a universal joint, respectively, for purposes of its rotation. Thus, the swivel motion of the polishing plate is driven and guided by the universal joint. The universal joint and the respective swivel axis are situated at minimum axial distance from the polishing plate, in order to assure a deflection with the least possible offset. The translatory, coaxial motion is pneumatically driven and guided by the cylindrical translatory axis. The use of a telescopic drive or the telescopic axes z1, z2 for the polishing plate lets one adjust the desired bearing pressure between the polishing plate and the workpiece. The translatory axis or telescopic guidance is of low friction, so that a maximum machining frequency or alternating frequency of the telescopic guidance is assured, even when the bearing force or bearing pressure is slight. Thus, especially when machining prismatic surfaces or free form surfaces, it is possible to adapt or cancel out the height difference resulting from the rotation. Besides the elasticity of the polishing tool and the polishing mount, the air-cushioned telescopic drive constitutes a drive unit which can regulate, in particular, the respective axial positioning of the tool relative to the workpiece, and the bearing force of the tool on the workpiece. The bellows is elastic in configuration and has a shock-absorbing action on the rotational drive and the tool, i.e., a portion of the drive motion introduced into the bellows is transformed into energy of deformation of the bellows and thus subtracted from the drive system, so that any interference frequencies or vibrations will be attenuated or extinguished.

As an alternative solution, the workpiece drives each have a translatory lifting axis arranged in parallel with the axis of rotation c1, c2, being mounted and driven so that they can move in its direction, and the displacement of the workpiece drives in the direction of the respective lifting axis is driven via a circulating ball spindle. In this way, one can adjust the particular workpiece drive in height or cause it to travel independently of the mounting of a workpiece, on the one hand, and during the machining of the workpiece, on the other. Especially when machining workpieces or lenses, one can therefore take into account the differing geometry of the lenses and the required orientation of the lenses during the machining. The actuation of this lift bearing also ensures the required machining and pressing forces separately for the two lenses.

As regards the configuration and arrangement of the invention, it is beneficial that the telescopic drives of the polishing plates have a common motor and are connected to it by a traction means, such as a poly-V-belt. The use of a poly-V-belt for the driving of the two polishing plates assures, on the one hand, a simple and favorable, as well as a very low-vibration and low-noise drive system. The workpiece drive will then ensure the speed relationships between the polishing plate and the workpiece, individually adjusted for the two lenses.

Moreover, it is beneficial to assign one tool changer each for the polishing plates, or a common tool changer for both polishing tools, having at least one tool magazine for polishing tools. Given the different lenses or pairs of lenses waiting to be machined or polished, the tool magazine serves to adapt the polishing station to the different surface radii of the lenses or different polishing methods. The use of two separate tool changers, i.e., an independent tool changer for each polishing plate, thereby ensures that the two polishing plates are largely independent of each other. The use of a common tool changer for both polishing plates is more simple and effective. If only one lens needs to be machined, a parking position is provided for the inactive workpiece drive and the inactive polishing unit. In this parked position, the inactive workpiece drive is not driven with regard to its individual axes and it is positioned with sufficient distance relative to the active workpiece drive, so that the active tool drive has maximum radius of action. The inactive polishing station is not supplied with polishing compound. This prevents the polishing plate from bearing against the inactive tool spindle.

Moreover, it is beneficial for the tool changer to be driven and able to move in the direction of a translatory transport axis t1, t2 and in the direction of a translatory exchanging axis a1, a2 arranged at right angles to it. Thus, one can cancel out the height difference between the tool magazine and the polishing plate, on the one hand, and the lateral offset between the tool magazine and the polishing plate, on the other, during the tool exchange.

Moreover, it is beneficial to configure the tool magazine as a revolving drum, and the drum is associated with a liquid container, by which at least a part of the tool, a whole tool or several tools can be wetted with liquid by the turning of the drum. The use of a liquid container, into which the various tools placed in the drum can be at least partly submerged by the turning of the drum, ensures a simple and clean wetting process and, thus, uniform machining conditions. The tool magazine is detachable, so that it can be placed separately in a liquid container for the wetting of the tools when shutting off the machining machine. The definite installed position is assured by a locking element.

It is beneficial for the tool magazine to have a quick locking unit for securing on the turning axis and a securing unit to determine the relative position within the machine. Thus, after the machine is switched off, the tool magazine or the drum can be removed and kept externally in a liquid container. In addition, the liquid container provided in the machine can be cleaned and maintained. A swift replacement is possible thanks to the quick locking element. The securing element is preferably of torsional type, providing for both the relative position on the turning axis and a definite coordination with the particular turning axis. Furthermore, a recognition or coordination of the position of the particular tool in the particular drum is provided, e.g., a numbering system.

It is also beneficial to provide a washing station with at least two washing places, which can be brought into a position S underneath the workpiece drive, and the washing station can be moved in translation in the direction of one lifting axis h. Thus, when the workpiece changer is in the swiveled position W2, being situated above the conveyor belt, the workpiece can be transported to the washing station above the workpiece drive. At the same time, the workpieces can be handed off directly after the washing, as soon as the tool changer swivels into its position W1 beneath the workpiece drive, after the washing station has been lowered.

For this, it is also beneficial that the workpiece spindle is connected to a swivel motor having the first swivel axis b1, b2, while the swivel motor is arranged via a translation carriage, having the displacement axis x1, x2, on a common swivel unit or swivel table, having the turning axis k, which can swivel about the turning axis k between a position A1 in the region of the workpiece changer and a position A2 in the region of the machining station. As a result of this, the necessary diversity of motion of the workpiece drives is assured, making use of the aforesaid axes in conjunction with the available drive units for the axes, such as circulating ball spindle drives. In addition, this makes possible a simple parallel use of a second workpiece drive, so that the machining time for a pair of lenses is roughly in the range of the machining time for one lens making use a robot arm. It should be noted that lenses are basically manufactured in pairs, so that thanks to the use of two workpiece drives and two machining stations one substantially simplifies the logistics, i.e., the bringing up and carrying away of the lenses, as well as the machining cycle for the lenses. The two workpiece drives each have a spindle rotation axis, thereby providing a guided rotation of the workpieces. The respective spindle or the respective workpiece drive can be swiveled via the first swivel axis b1, b2 in a pendulum motion. This pendulum motion is provided by a swivel motor. The swivel motor is arranged together with the respective workpiece drive on a translation carriage, able to move in translation. The translation carriage moves in the direction of the axis of translation and is separately actuated and driven for each workpiece drive and each swivel motor. The two workpiece drives thus constructed, including the swivel motors and the translatory carriages, are together arranged on a swivel unit configured as a swivel plate and are swiveled via this swivel plate about the turning axis k and optionally lifted or lowered in a direction parallel to a lifting axis w. The swivel motion about the turning axis k serves for the positioning of the two workpiece drives in the region of the machining station, on the one hand, and in the region of the workpiece changer or the workpiece stock, or a washing station, on the other hand. The lifting and lowering motion in the direction of the lifting axis w serves for a positioning in the region of the machining station or in the region of the tool changer or the washing station. The thus achieved independence of the machining and polishing process will be appropriately attuned in order to optimize the available space, in particular, the translatory axes and the swivel axes b1, b2. The two workpiece drives are arranged relatively close to each other, so that a fully independent movement is not provided in the region of the aforesaid axes. The machining process will be adjusted so that a collision of the two workpiece drives or workpiece spindles is avoided.

It is beneficial that the particular translatory carriage can move via a circulating ball spindle in the direction of the axis of translation and the circulating ball spindle is driven by a toothed belt, while both translatory carriages have a common or a separate guide rail. To ensure an optimal polishing process, the position of the workpiece relative to the axis of translation needs to be known. The common guide rail ensures optimal available space.

Furthermore, it is beneficial for the spindle drive to be configured as a continuous direct drive with a digital or analog control. Thus, the angle position of the workpiece relative to the axis of rotation c1, c2 can be quickly and easily regulated. Besides the controlling of the axis of rotation c1, c2 for the polishing process in itself, the relative position of the lens with respect to the axis of rotation c1, c2 is thus given from the beginning to the end of the machining process. Thus, the lens can be handed off in the desired angular position to the conveyor belt or the lens stock. It is also beneficial for the swivel unit to be driven via a swivel arm with a lift cylinder able to turn about the turning axis. Since the swivel unit in the axis combination represented here according to the invention need only move back and forth between two positions, the drive for the swivel unit can be configured very simple in the manner of a translatory lift cylinder. In particular, since only a 90° swivel is involved, such a lift cylinder can be used with no cumbersome gearing.

During the machining sequence of the machine, it is beneficial for at least the lifting motion in the direction of the lifting axis w and the swivel motion about the turning axis k to occur in common for both tool drives. In this way, the maximum number of necessary axes of motion for the two workpiece drives are coupled together and this substantially simplifies the motion sequence.

It is also beneficial to coordinate the individual motion sequence of the two swivel axes b1, b2 and the two displacement axes x1, x2 during the machining of the lenses, in order to prevent a collision of the spindles 4.1, 4.1'. The two workpiece drives are arranged in common on a swivel plate, and one translatory carriage is provided. Since the size of the swivel plate is reduced to a minimum, a maximum freedom of motion of the workpiece drives independently of each other is not possible. Therefore, the coordination of the axes ensures the individual machining of the two workpieces.

In addition, it is beneficial that the tool magazine is removed from the machining machine and kept in liquid on the outside, and the tool magazine is installed and secured in the machine with regard to its relative position. This enables a shutting off of the machine at any given time, without danger of the tools drying out.

BRIEF DESCRIPTION OF THE DRAWINGS

Additional benefits and details of the invention are explained in the claims and in the specification and represented in the drawings. These show:

DETAILED DESCRIPTION OF THE INVENTION

Figure 1:
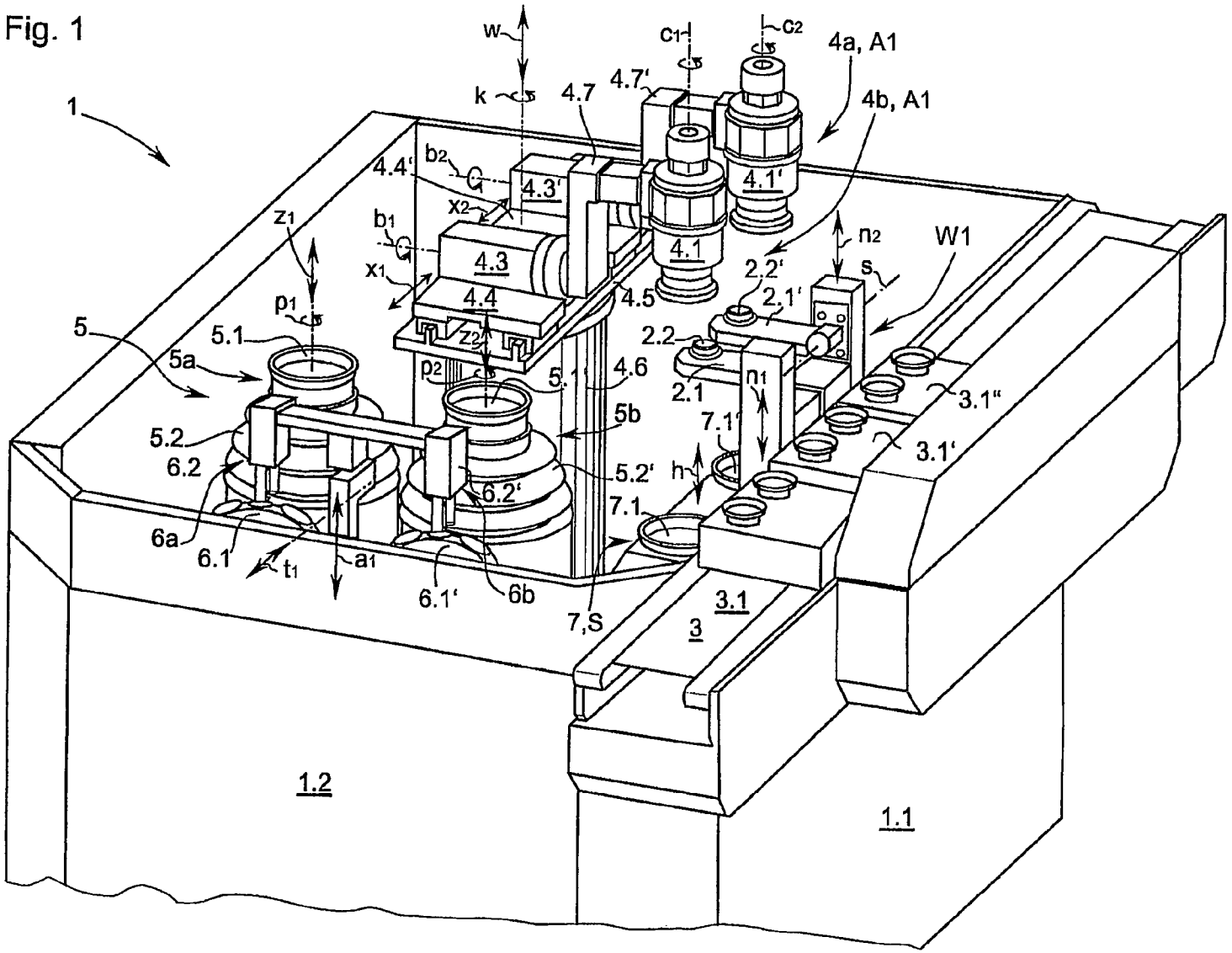
FIG. 1, a perspective representation of the polishing machine with workpiece drive, polishing unit, and workpiece changer.

A machining machine as represented in FIG. 1 and configured as a polishing machine 1 has a conveyor belt 3 for optical lenses or workpiece boxes 3.1-3.1", by which the transport boxes 3.1-3.1" are delivered to a pair of workpiece changers 2.1, 2.1' of the polishing machine 1. The respective workpiece changer 2.1, 2.1' is configured as a swivel arm, which can swivel 180° about a swivel axis s. At the free end of the respective swivel arm 2.1, 2.1' there is provided a suction cup 2.2, 2.2' to receive a workpiece, or lens. The suction cup 2.2, 2.2' is connected via pneumatic lines (not shown) to a low pressure receiver or pump (not shown). In order to pick up the lenses or pass the lenses on, the workpiece changer 2.1, 2.1' furthermore has a linear guide able to travel in the direction of a respective lowering axis n1, n2, not further represented, by which the two swivel arms 2.1, 2.1' can move essentially in the vertical direction, perpendicular to the swivel axis s. To pick up a pair of lenses, starting from position P1 of FIG. 1, the two swivel arms 2.1, 2.1' are swiveled 180° into a position P2 (not shown) and then brought to bear against the lenses being picked up in the direction of the lowering axis n1, n2. After generating the necessary vacuum by means of the above-mentioned low pressure receiver (not shown), or certain pneumatic valves, the two swivel arms 2.1, 2.1' are swiveled 180° into their starting position W1, as depicted, so that the lenses picked up can then be grabbed by a workpiece drive 4*a*, 4*b* at their block piece arranged on one side and not further depicted.

The conveyor belt 3 and the workpiece changers 2.1, 2.1' are located in the region of one sidewall 1.1, of the polishing machine 1. The polishing machine 1 is bounded by four sidewalls, of which one end wall 1.2 forms the front enclosure in FIG. 1.

Inside the polishing machine 1, in the region of this front end wall 1.2, a polishing station 5 is provided. Roughly in the middle of the polishing machine 1 are provided two workpiece drives 4*a*, 4*b*, being mounted by a common swivel unit, configured as a swivel plate 4.5, with a common swivel column 4.6 inside the polishing machine. In addition, in the region of the sidewall 1.1, beneath the workpiece changer 2.1, 2.1', there is provided a washing station 7, which can be moved vertically and positioned in the direction of a lifting axis h by means of a drive, not further represented.

Figure 3:
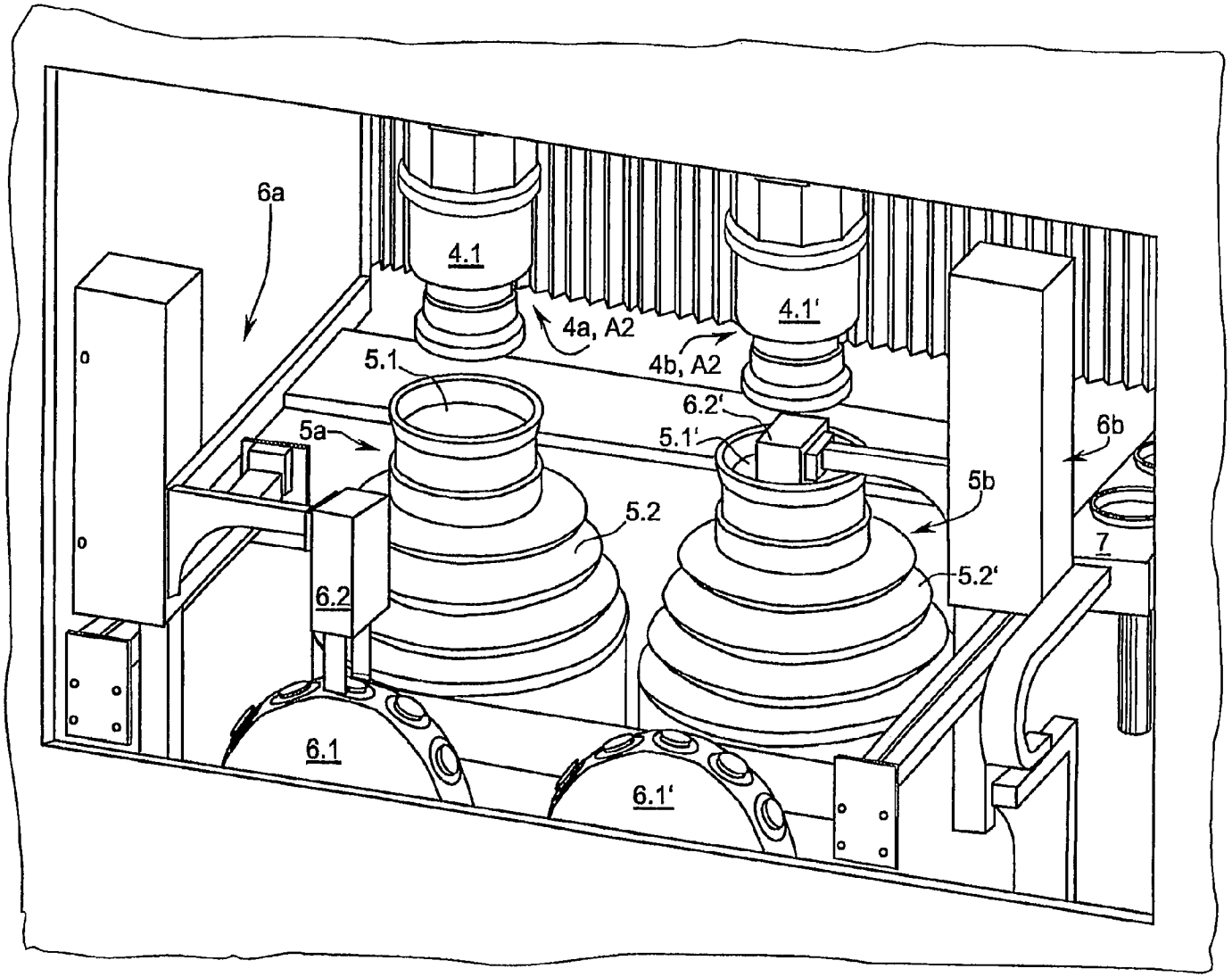
FIG. 3, the machining machine of FIG. 1 with the workpiece drive in the position above the polishing station and tool changer in the change position.

The swivel plate 4.5 with the two workpiece drives 4*a*, 4*b* can be swiveled via the swivel column 4.6, starting from position A1 of the workpiece drives 4*a*, 4*b* in the region of the workpiece changer 2.1, 2.1' through 90° into a position A2 per FIG. 3. In this position A2, the two workpiece drives 4*a*, 4*b* are positioned directly above the polishing station 5. This swivel motion occurs about a turning axis k, while the swivel column 4.6 or swivel plate 4.5 is additionally able to move vertically in the direction of a lifting axis w and be positioned in parallel with the turning axis k.

On the swivel plate 4.5 are situated two translatory carriages 4.4, 4.4' for the respective workpiece drive 4*a*, 4*b*. The respective translatory carriage 4.4, 4.4' is moved in translatory motion and positioned in the direction of a displacement axis x1, x2 by a circulating ball spindle (not shown). This translatory motion occurs separately and independently for both translatory carriages 4.4, 4.4'.

On the respective translatory carriage 4.4, 4.4' is located a swivel motor 4.3, 4.3', on which a cranked swivel arm 4.7, 4.7' is arranged and able to swivel. The swivel motor 4.3, 4.3' has a swivel axis b1, b2 arranged at right angles to the displacement axis x1, x2, so that the swivel arm 4.7, 4.7' and thus the workpiece drive 4*a*, 4*b* arranged on it can be placed in pendulum motion about said swivel axis b1, b2.

At the free end of the swivel arm 4.7, 4.7', there is arranged the respective workpiece drive 4*a*, 4*b* with a respective workpiece spindle 4.1, 4.1' able to turn about an axis of rotation c1, c2. The workpiece spindle 4.1, 4.1' has a chuck for the workpiece or for a block piece of a lens (not shown). The axis of rotation c1, c2 is arranged essentially vertical in the starting position and at right angles to the respective displacement axis x1, x2, disregarding the swivel motion about the respective swivel axis b1, b2.

The lowering axis n1, n2 of the workpiece changer 2.1, 2.1' as well as the lifting axis w of the workpiece drives 4*a*, 4*b* are arranged in parallel, so that a combined and thus very fast movement in the direction of the respective axes is possible for purposes of handing off the lenses or the workpiece.

After hand-off of the lenses, the two workpiece drives 4*a*, 4*b* are swiveled together by the swivel column 4.6 into position A1 above the polishing station 5 per FIG. 3.

The polishing station 5 has two polishing units, each with a polishing plate 5*a*, 5*b*. The respective polishing plate 5*a*, 5*b* can turn about a polishing axis p1, p2 and can move telescopically and with air cushioning in the direction of a respective telescopic axis z1, z2, coaxially to the polishing axes p1, p2, via a telescopic drive (not further depicted), and thereby be brought up against the workpiece. In order to seal the respective polishing plate 5.1, 5.1' and provide for necessary coordination of the polishing motion and the telescopic motion, the respective polishing unit 5*a*, 5*b* has a bellows 5.2, 5.2'. The bellows 5.2, 5.2' has at its upper end an opening to receive the respective workpiece drive 4*a*, 4*b*, which after descending into the respective polishing unit 5*a*, 5*b* is tightly sealed off by the bellows 5.2, 5.2'. During the polishing process, the pressing force of the polishing plate 5*a*, 5*b* can be raised or lowered in the direction of the respective telescopic axis z1, z2 in order to thereby control the polishing process. Moreover, the respective workpiece drive 4*a*, 4*b* and the respective tool spindle 4.1, 4.1' can be swiveled about the respective swivel axis b1, b2 via the swivel motor 4.3, 4.3'. This makes it possible to adjust the setting of the angular position between the polishing plate 5*a*, 5*b* with the respective tool 5.1, 5.1' and the workpiece. In addition, the respective workpiece drive 4*a*, 4*b* can be moved via the respective translatory carriage 4.4, 4.4' in the direction of the displacement axis x1, x2 in sideways direction to the respective polishing plate 5*a*, 5*b*. It should be noted that, based on FIG. 1, all axes of the workpiece drive 4*a*, 4*b*, i.e., the axis of rotation c1, c2, the swivel axis b1, b2 and the displacement axis x1, x2 are turned 90° about the turning axis k.

The polishing station 5 and the respective polishing unit 5*a*, 5*b* is coordinated with a tool changer 6*a*, 6*b*. The tool changer 6*a*, 6*b* can be moved and positioned horizontally in the direction of a transport axis t1, essentially in translatory motion, and also moved and positioned by translatory movement essentially in the vertical direction, by means of an exchange axis a1, a2. At the particular free end of the tool changer 6*a*, 6*b* there is provided a tool gripper 6.2, 6.2', used to secure and release the particular tool 5.1, 5.1'.

According to sample embodiment 1, a common tool changer 6 is provided for both polishing plates 5*a*, 5*b*, which can be moved and positioned via a common transport axis t1 and a common exchange axis a1, and it has at its free end a tool gripper 6.2, 6.2' for each polishing plate 5*a*, 5*b*. According to the sample embodiment in FIG. 3, a separate tool changer 6*a*, 6*b* is provided for each polishing plate 5*a*, 5*b*, and both tool changers 6*a*, 6*b* can be moved and positioned independently of each other in the direction of the transport axis t1, t2 and in the direction of the exchange axis a1, a2. The tool gripper 6.2 is located directly on a tool drum 6.1, while the tool gripper 6.2' is arranged directly above the polishing plate 5.1'.

In both sample embodiments, the respective tool gripper 6.2, 6.2' is coordinated with a tool magazine or a tool drum 6.1, 6.1', which has several tools 5.1, 5.1' in stock, distributed about its circumference. The respective tool drum 6.1, 6.1' is arranged so that it can turn and its lower end (not further depicted) can plunge into a liquid container, not further depicted. By rotation of the respective tool drum 6.1, 6.1', the tools contained in the tool drum 6.1, 6.1' are thus wetted as needed.

Figure 2:
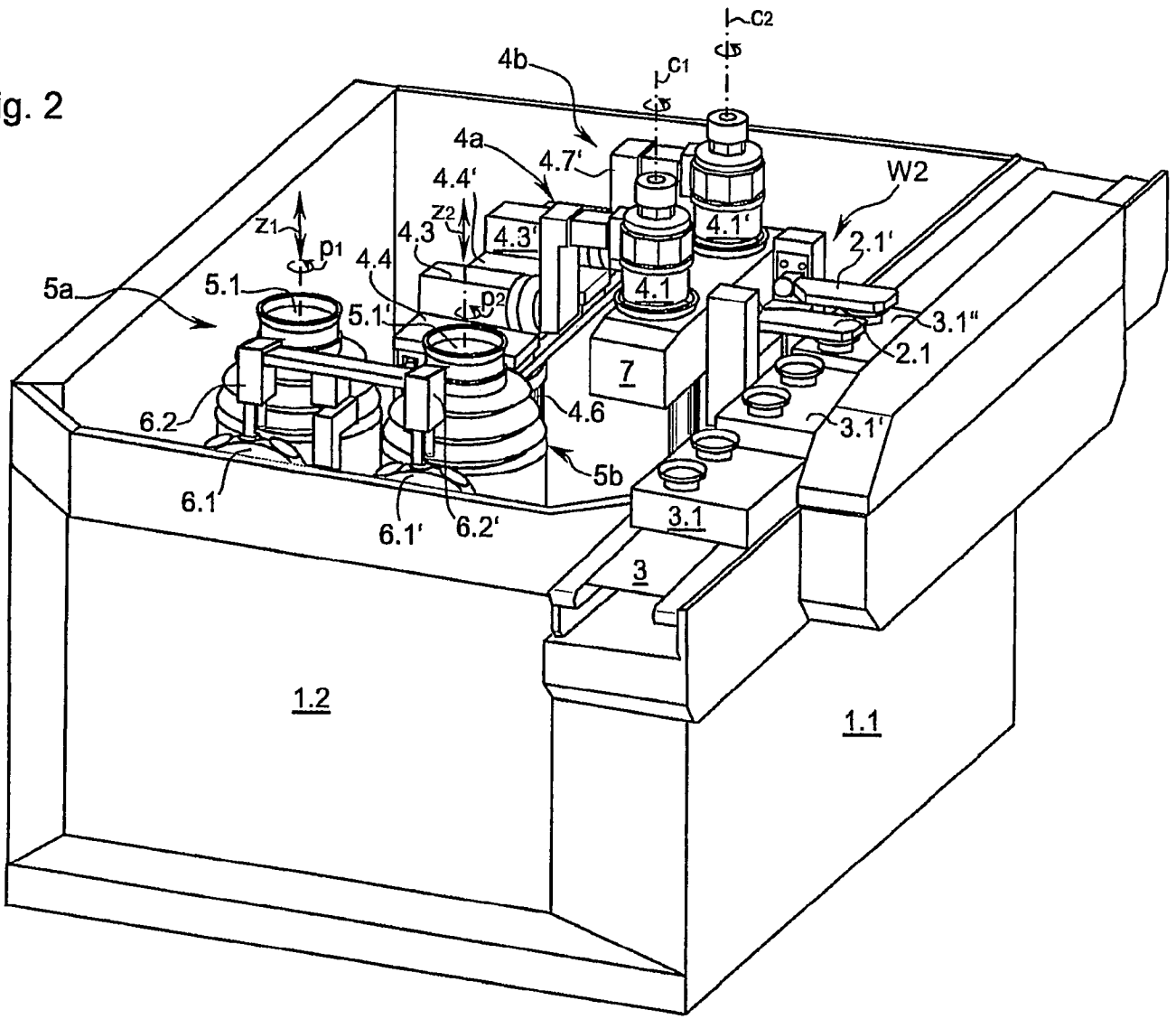
FIG. 2, the polishing machine per FIG. 1 with washing station lifted.

After the polishing of the lenses, the swivel column 4.6 with the two workpiece drives 4*a*, 4*b* swivels to the starting position Al of FIGS. 1 and 2. Per FIG. 2, the tool changer 2.1, 2.1' is located in its position W2 immediately above the conveyor belt 3. For the washing of the lenses, the washing station 7 starting from its lowered position S travels upward in the direction of the lifting axis h, so that the lenses can be dipped into the washing station 7 via the workpiece drives 4*a*, 4*b* and the lifting axis w in combination with the lifting motion in the direction of the lifting axis h. In the washing station 7, the lenses are sprinkled off and then spun dry via the workpiece drive 4*a*, 4*b*.

After the washing, the washing station 7 travels to its lower starting position S per FIG. 1, while the workpiece changer 2.1, 2.1' likewise swivels 180° to its receiving position W1 per FIG. 1, travels in the direction of its lowering axis n1, n2 for removal of the finished lenses, and then picks up the finished lenses via the two suction cups 2.2, 2.2' and hands them off to the conveyor belt 3.

LIST OF REFERENCE NUMBERS

1. Machining machine, polishing machine
1.1 Sidewall
1.2 End wall
2.1 Workpiece changer, swivel arm
2.1' Workpiece changer, swivel arm
2.2 Suction cup
2.2' Suction cup
3 Workpiece stock, conveyor belt
3.1 Transport box with workpiece
3.1' Transport box with workpiece
3.1" Transport box with workpiece
4*a* Workpiece drive, transport receptacle
4*b* Workpiece drive, transport receptacle
4.1 Tool spindle
4.1' Tool spindle
4.3 Swivel motor
4.3' Swivel motor
4.4 Translatory carriage
4.4' Translatory carriage
4.5 Swivel plate, swivel unit
4.6 Swivel column
4.7 Swivel arm
4.7' Swivel arm
5 Machining station, polishing station
5*a* Polishing unit, polishing plate
5*b* Polishing unit, polishing plate
5.1 Tool, polishing plate
5.1' Tool, polishing plate
5.2 Bellows
5.2' Bellows
6 Tool changer
6*a* Tool changer
6*b* Tool changer
6.1 Tool magazine, tool drum
6.1' Tool magazine, tool drum
6.2 Tool gripper
6.2' Tool gripper
7 Washing station
7.1 Washing place
7.1' Washing place
A1 Position of swivel unit
A2 Position of swivel unit
S Position of washing station
W1 Position of workpiece changer
W2 Position of workpiece changer
c1 Axis of rotation
c2 Axis of rotation
b1 First swivel axis
b2 First swivel axis
k Turning axis
w Lifting axis w
x1 Displacement axis
x2 Displacement axis
z1 Telescopic axis
z2 Telescopic axis
s Swivel axis
n1 Lowering axis
n2 Lowering axis
p1 Polishing axis
p2 Polishing axis
t1 Transport axis
t2 Transport axis
a1 Exchange axis
a2 Exchange axis
h Lifting axis

What is claimed is:

1. A machining machine for lenses comprising: first and second workpiece drives configured as transport receptacles each having, with a workpiece spindle; a workpiece changer for exchanging workpieces between the workpiece drives and a workpiece stock; and a machining station for machining a workpiece, wherein:

a) the workpiece spindle of the first workpiece drive rotates about an axis of rotation (c1), b) the first wordpiece drive swivels about a first swivel axis (b1) arranged at a right angle to the axis of rotation (c1) and c) the first workpiece drive turns about a turning axis (k) arranged at a right angle to the first swivel axis (b1), d) the second workpiece drive spindle which turns about an axis of rotation (c2), e) the second workpiece drive swivels about a second swivel axis (b2) arranged at a right angle to the axis of rotation (c2), and f) both workpiece drives can turn together about the turning axis (k).

2. The device according to claim 1, wherein the workpiece drives have a common translatory lifting axis (w), arranged in parallel with the turning axis (k), being mounted and driven to move along the lifting axis (w).

3. The device per claim 1, wherein two workpiece changers are provided and each of the workpiece changers can swivel about a swivel axis (s) arranged at right angles to a lifting axis (w) of the workpiece drives between a position W1 beneath the workpiece drive and at least one position W2 above the workpiece stock and is driven in translatory motion in the direction of a lowering axis (n1, n2) arranged in parallel with the lifting axis (w).

4. The device according to claim 1, wherein the workpiece can be transported by the workpiece changer between a position beneath the workpiece drive and a position above the workpiece stock and can be swiveled through 180° in this process.

5. The device according to claim 1, wherein the machining station is configured as a polishing station and has at least two polishing plates, each of which are driven and guided to turn about a polishing axis (p1, p2) and move in the direction of a translatory telescopic axis (z1, z2), arranged in parallel with the polishing axis (p1, p2).

6. The device according to claim 5, wherein the respective polishing plate has an air-cushioned telescopic drive, able to turn about the polishing axis (p1, p2) and move in the direction of the telescopic axis (z1, z2), while the polishing plate is connected via a bellows and a universal joint to the polishing axis (p1, p2).

7. The device according to claim 6, wherein the telescopic drives of the polishing plates have a common motor and are connected to it via a traction means, such as a poly-V-belt.

8. The device according to claim 5, wherein the polishing plates are each coordinated with a tool changer or a common tool changer, having at least one tool magazine for polishing tools.

9. The device according to claim 8, wherein the tool changer is driven and can move in the direction of a translatory transport axis (t1, t2) and in the direction of a translatory exchange axis (a1, a2), arranged at right angles to translatory transport axis (t1,t2).

10. The device according to claim 8, wherein the tool magazine is configured as a revolving drum, and the drum is coordinated with a liquid container, by which at least a part of the tool can be wetted with liquid by the turning of the drum.

11. The device according to claim 10, wherein the tool magazine has a quick locking element for securing in a relative position along the particular drum turning axis and a securing element determining the relative position within the machine.

12. The device according to claim 1, wherein a washing station is provided with at least two washing places, which can be brought into a position S underneath the workpiece drive.

13. The device according to claim 12, wherein the washing station can move in translatory motion in the direction of a lifting axis (h).

14. The device according to claim 1, wherein the workpiece spindles are connected to respective swivel motors having the first swivel axis (b1, b2), wherein the swivel motors are arranged via a translatory carriage having the displacement axis (x1, x2) on a common swivel unit having the turning axis (k), which can swivel about the turning axis (k) between a position A1 in the region of the workpiece changer and a position A2 in the region of the machining station.

15. The device according to claim 14, wherein the respective translatory carriage can move via a circulating ball spindle in the direction of the translatory axis and the circulating ball spindle is driven via a toothed belt, while both translatory carriages have a common or a separate guide rail.

16. The device according to claim 1, wherein the spindle drive is configured as a continuous direct drive.

17. The device according to claim 14, wherein the swivel unit is configured as a swivel plate and is driven to turn about the turning axis (k) by a swivel arm with a lift cylinder.

18. The device according to claim 1, wherein both workpiece drives are driven in translatory motion and can each move in the direction of a translatory axis of displacement (x1, x2), arranged at right angles to the first swivel axis (b1, b2).

19. A method for operating a machining machine for lenses, comprising the steps of:

utilizing a machining machine comprising: a first and a second workpiece drive each configured as a transport receptacle and each having a workpiece spindle; a workplace changer for changing work pieces between the workpiece drives and a workpiece stock; and a machining station for machining a workpiece, wherein:

a) the first workpiece spindle of the workpiece drive rotates about an axis of rotation (c1), b) the first workpiece drive swivels about a first swivel axis (b1) arranged at a right angle to the axis of rotation (c1), c) the first workpiece drive turns about a turning axis (k) arranged at a right angle to the first swivel axis (b1), d) the second workpiece spindle turns about an axis of rotation (c2), e) the second workpiece drive swivels about a second swivel axis (b2) arranged at a right angle to the axis of rotation (c2), and f) both workpiece drives can turn together about the turning axis (k), wherein the workpiece drives have a common translatory lifting axis (w), arranged in parallel with the turning axis (k), being mounted and driven to move along the lifting axis (w), and wherein at least the lifting motion in the direction of the lifting axis (w) and the swivel motion about the turning axis (k) occurs in common for both workpiece drives.

20. The method for operating a machining machine according to claim 19, wherein the individual motion sequence of the two swivel axes (b1, b2) and two displacement axes (x1, x2) is attuned while machining the lenses, so as to avoid a collision of the spindles.

21. A method for operating a machining machine for lenses, comprising the steps of:

utilizing a machining machine comprising: a first and a second workpiece drive each configured as a transport receptacle and each having a workpiece spindle; a workpiece changer for changing work pieces between the workpiece drives and a workpiece stock; and a machining station for machining a workpiece, wherein:

a) the first workpiece spindle of the workpiece drive rotates about an axis of rotation (c1), b) the first workpiece drive swivels about a first swivel axis (b1) arranged at a right angle to the axis of rotation (c1), c) the first workpiece drive turns about a turning axis (k) arranged at a right angle to the first swivel axis (b1), d) the second workpiece spindle turns about an axis of rotation (c2), e) the second workpiece drive swivels about a second swivel axis (b2) arranged at a right angle to the axis of rotation (c2), and f) both workpiece drives can turn together about the turning axis (k), wherein the machining station is configured as a polishing station and has at least two polishing plates, each of which are driven and guided to turn about a polishing axis (p1, p2) and move in the direction of a translatory telescopic axis (z1, z2), arranged in parallel with the polishing axis (p1, p2), wherein the polishing plates are each coordinated with a tool changer or a common tool changer, having at least one tool magazine for polishing tools, and wherein a) the tool magazine is detached for removal from the machining machine and kept outside in liquid for wetting; and b) the tool magazine is installed in the machine and fastened with regard to a definite position.

* * * * *